United States Patent [19]

Echtler et al.

[11] Patent Number: 4,493,122

[45] Date of Patent: Jan. 15, 1985

[54] MOTOR VEHICLE FOR TRANSPORTING AND LAYING A FIXED BRIDGE

[75] Inventors: Theodor Echtler, Kaiserslautern; Martin Quinot, Selchenbach; Werner Hunsinger, Kaiserslautern, all of Fed. Rep. of Germany

[73] Assignee: IBEK Ingenieurbuero Echtler Kaiserslautern GmbH, Kaiserslautern, Fed. Rep. of Germany

[21] Appl. No.: 492,198

[22] Filed: May 6, 1983

[30] Foreign Application Priority Data

May 8, 1982 [DE] Fed. Rep. of Germany ..... 3217435

[51] Int. Cl.[3] ..... E01D 15/12

[52] U.S. Cl. ..... 14/2.4

[58] Field of Search ..... 14/2.4, 2.6, 1, 2

[56] References Cited

U.S. PATENT DOCUMENTS

| | | | |
|---|---|---|---|
| 3,491,391 | 1/1970 | Söffge | 14/2.4 |
| 3,820,181 | 6/1974 | Wagner et al. | 14/2.4 |
| 4,288,881 | 9/1981 | Mahncke et al. | 14/2.4 |

FOREIGN PATENT DOCUMENTS

| | | | |
|---|---|---|---|
| 1224350 | 9/1966 | Fed. Rep. of Germany . | |
| 2641807 | 3/1978 | Fed. Rep. of Germany . | |
| 2166758 | 2/1979 | Fed. Rep. of Germany . | |
| 2926594 | 1/1981 | Fed. Rep. of Germany . | |
| 3011222 | 10/1981 | Fed. Rep. of Germany | 14/2.4 |
| 2502659 | 10/1982 | France | 14/2.4 |
| 180327 | 8/1962 | Sweden | 14/1 |

OTHER PUBLICATIONS

Abell, William R., "Bridging for the 1980's", *The Military Engineer,* Nov.-Dec., 1974.

*Primary Examiner*—Stephen J. Novosad
*Assistant Examiner*—Beverly E. Hjorth
*Attorney, Agent, or Firm*—Shlesinger, Arkwright, Garvey & Fado

[57] ABSTRACT

A motor vehicle for transporting and laying a fixed bridge includes a ground supported vehicle having a chassis with a front and a rear. The slide frame is longitudinally displacably mounted to the chassis and has a first travel position and a second extended position wherein a first end of the slide frame is disposed a substantial distance from the rear. A support leg is secured to the first end and includes a ground engaging portion extending beyond the lower surface of the slide frame and supporting the slide frame. A bridge member is carried by the slide frame. A bridge member laying and displacement device is connected generally to said first end and includes a rearwardly extending portion adapted for supporting the bridge member during displacement thereof.

26 Claims, 9 Drawing Figures

MOTOR VEHICLE FOR TRANSPORTING AND LAYING A FIXED BRIDGE

The invention is relative to a motor vehicle, especially a wheeled or tracked vehicle, for transporting and laying a fixed bridge, with a slide frame which is guided so that it can move in a longitudinal direction of the motor vehicle and functions as a bridge carrier, and with a laying device positioned on the slide frame, as well as with ground support elements.

Such a vehicle is described in DE-OS 29 26 594. An auxiliary frame is mounted on its box frame, and a bridge carrier which can move in the longitudinal direction of the vehicle is mounted on the auxiliary frame. The laying device with the fixed bridge is positioned on the bridge carrier.

During transport the fixed bridge is divided into two bridge segments which are stacked over one another. For the unloading procedure, the bridge carrier is pushed so far forward that after the bridge segments have been coupled together, the fixed bridge can be set down by the laying device. In order to couple the two bridge segments together, the lower bridge segment is pushed forward and the upper bridge segment is lowered. Then, the coupled fixed bridge is extended by the laying arm over the barrier to be bridged and is set down. After the fixed bridge has been taken up, it is put back into a position by pushing back the bridge carrier, which results in an optimum distribution of axial load for travel and thus makes the vehicle more maneuverable.

The basic prerequisite for such a laying in free extension is that the tipping moment produced by the freely projecting bridge must be less than the standing moment of the vehicle. This determines the maximum bridge length which can be laid at a given vehicle weight. In order to increase the bridge length, the standing moment must be increased, since the tipping moment can hardly be influenced. However, the movable bridge carrier described above is unsuited for this.

The vehicle according to DE-OS 29 26 594 does have additional support legs under the driver's cab, which extends over the front axle, which legs support the vehicle on the ground when the fixed bridge is laid. However, this does not decisively improve the standing moment of the vehicle set by the axle. If bridges are to be laid, the tipping moment of which is greater than the standing moment of the vehicle, then the fixed bridge must be equipped with an extension beak which extends out of the bridge tip and is set on the opposite bank before the fixed bridge is pushed after it. This makes the laying system considerably more complicated and therewith more susceptible to breakdowns and more expensive.

In order to improve the stability of bridge-laying vehicles, DE-OS 26 41 807 suggests providing support legs which can be pivoted forward in front of the vehicle. However, this necessitates a correspondingly lengthened laying arm in order that the fixed bridge can be set down. Since the support legs are attached to the vehicle itself, their forward position after pivoting can only be relatively small for reasons of strength, so the stability is likewise insufficient in the case of rather long fixed bridges.

The invention has the task of constructing a motor vehicle of the type initially mentioned in such a manner that in spite of its light construction, fixed bridges can be laid with it which are considerably longer than the currently comparable fixed bridges.

The invention solves this task as follows: The slide frame is made self-supporting and can be extended over at least one end of the motor vehicle, while the ground support element for supporting the projecting part of the slide frame is located on it.

Here, in distinction to the motor vehicle described in DE-OS 29 26 594, the slide frame can be moved out together with the fixed bridge over at least one end of the motor vehicle and is then caught there by the ground support elements. This creates a correspondingly long lever arm between the ground support elements and the center of gravity of the vehicle, so that the standing moment when the slide frame is extended is considerably greater than is the case in the known solutions. Very long fixed bridges can be laid in this manner, even with light vehicles. The force of the weight of the fixed bridge is conducted directly over the motor vehicle into the ground.

Another advantage is the fact that the slide frame creates a sharp transition between the motor vehicle and the laying device. This makes it easier to convert a mass-produced motor vehicle to a bridge-laying vehicle, as this conversion is essentially limited to adding on the guide tracks or rollers and a hydraulic pump. There are only a few connection paths for the energy supply between the motor vehicle and the slide frame, so that the frame can be separated and removed from the motor vehicle. This makes servicing easier and reduces the outage times of the entire system, since motor vehicles and frames can be exchanged among each other.

The invention provides that the slide frame can be moved by approximately its entire length over one end or over the ends of the motor vehicle in order to obtain as long a lever arm is possible. The step of positioning the ground support elements on the end of the projecting part of the slide frame also has the same effect. The elements for standing on the ground should be constructed as extensible or pivotable support legs.

The movable bearing of the slide frame can be accomplished in various ways. The invention provides that the slide frame is carried on the motor vehicle by rollers, because this makes moving especially easy. It should also be guided laterally by vertically mounted rollers.

In one embodiment the rollers are carried on the slide frame and run in guide tracks mounted on the motor vehicle. This construction is especially advantageous if the slide frame has only one set of rollers in the area of the end which can not be moved out, but otherwise lies loosely on the motor vehicle. The slide frame should be able to be lifted far enought by the ground support elements that its end which can move out lifts up readily from the end of the motor vehicle. Once this raising has been executed, the motor vehicle can advance until the set of rollers strikes against the back end of the guide tracks, whereby the slide frame remains standing on the ground support elements. The fixed bridge can be laid off by the laying device. The advantage of this embodiment is that the slide frame does not require its own drive in order to be pushed out. However, this embodiment can only be used on relatively level terrain.

As an alternative to the above, the slide frame can be movably carried on two sets of rollers positioned at a distance from one another in the longitudinal direction of the motor vehicle. In this embodiment the slide frame is moved out to the rear with the fixed bridge in a cantilevered fashion for the laying process while the motor vehicle remains standing. The ground support elements are not lowered until the extension has been completed.

In this embodiment the sets of rollers should be positioned on the motor vehicle in the area of the end or ends over which the slide frame can be moved out, or on the slide frame and the guide tracks on the motor vehicle.

The invention finally provides that the fixed bridge can move on the slide frame and/or the slide frame can move under the fixed bridge, so that the center of gravity of the fixed bridge can always be maintained in a favorable position, especially in a coupled state, before the actual laying procedure begins.

The drawings illustrate the invention in more detail in two embodiments.

Figure 1:
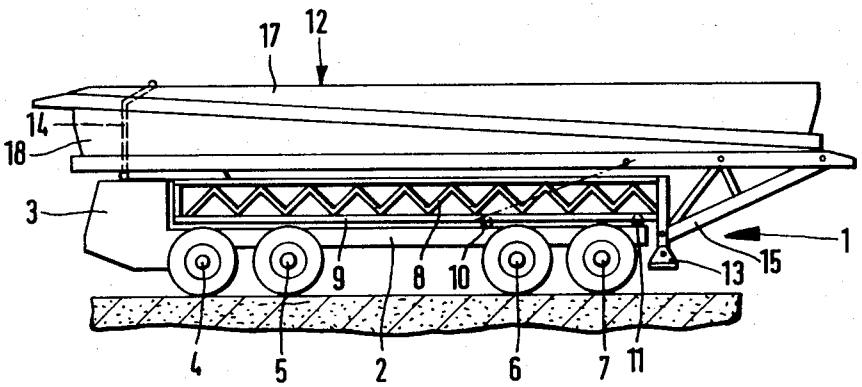
FIGS. 1 to 8 show a motor vehicle with a fixed bridge during the laying procedure in various positions.

Bridge-laying vehicle 1 shown in FIGS. 1 to 8 has a chassis frame 2 with a driver's cab located at the front. Four wheel axles 4, 5, 6, 7 are suspended from chassis frame 2.

Latticelike slide frame 8 is set on chassis frame 2 and has longitudinally-running guide tracks 9 on both sides. It is mounted so that it can move on two sets of rollers 10, 11 mounted at a distance frome one another at the rear of chassis frame 2 with two opposing rollers or roller groups each which fit into guide tracks 9 on slide frame 8. A support leg 13 which can be extended downward is fastened to each side of the rear end of slide frame 8.

A two-piece fixed bridge 12 is positioned on slide frame 8. Arm 14 is articulated to the front end of slide frame 8 and laying arm 15 located at the rear end of slide frame 8 form part of a laying device with which fixed bridge 12 can be spanned following the progression shown in FIGS. 2 to 8 over body of water 16, for example.

FIG. 1 shows the travelling position of bridge-laying vehicle 1, in which slide frame 8 rests entirely on chassis frame 2, support legs 13 are drawn up and fixed bridge 12 is divided into two bridge segments 17, 18 which are thrust over one another.

Figure 2:
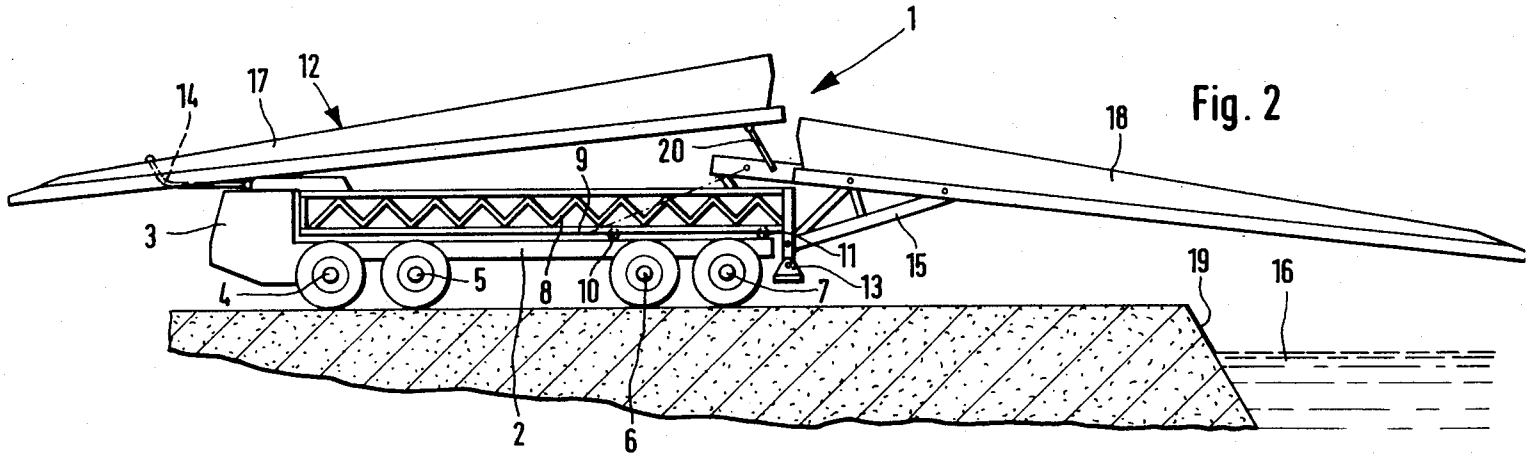

FIG. 2 shows the start of the laying procedure on bank 19 of body of water 16. Lower bridge segment 18 is moved out and down over laying arm 15 and is pivoted somewhat downward with it, while upper bridge segment 17, guided by arm 14 and an auxiliary arm 20, moves obliquely forward and down.

Figure 3:
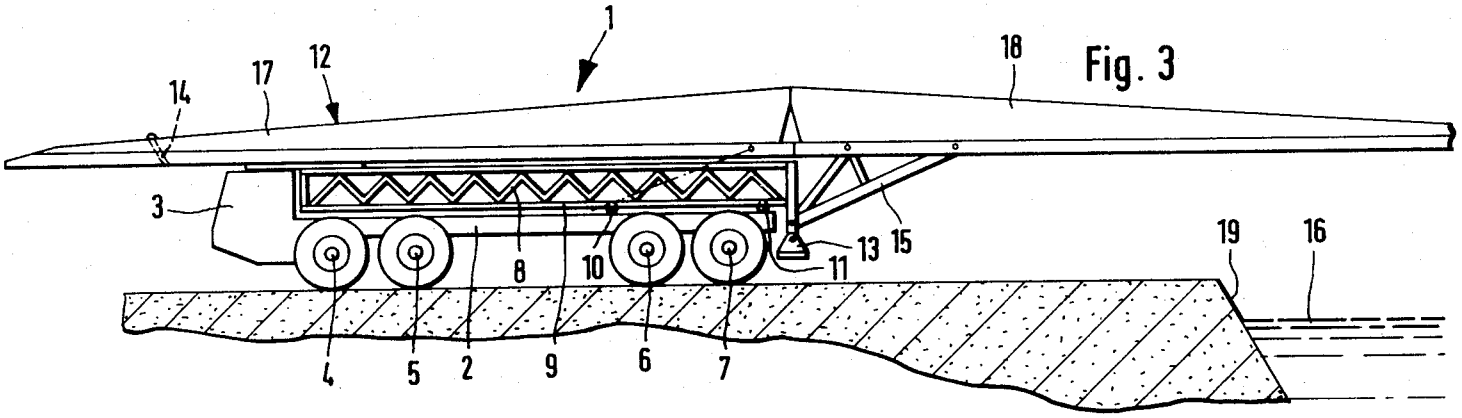

In FIG. 3 the two bridge segments 17, 18 are coupled to one another in the middle after left bridge segment 17 has been lowered and right bridge segment 18 has been pivoted up.

Figure 4:
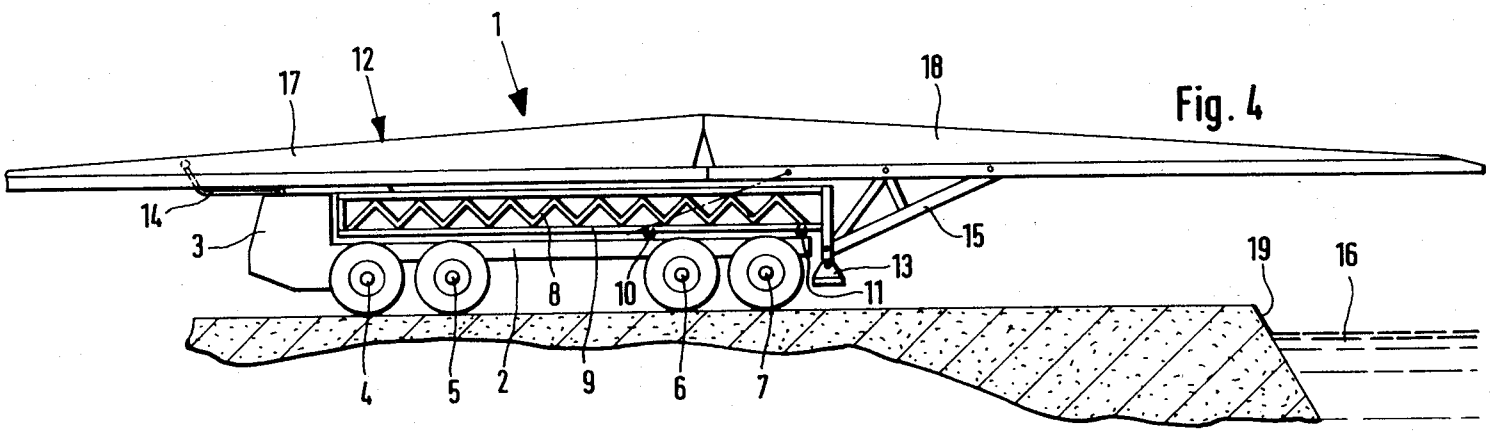
Figure 5:
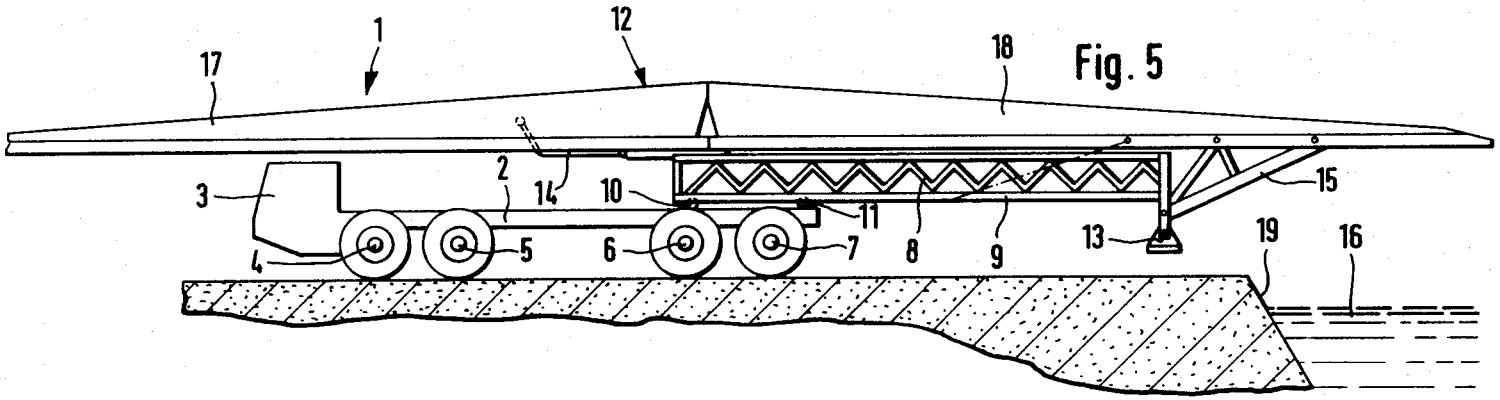

As FIG. 4 shows, the coupled fixed bridge 12 is moved as a unit toward the front, that is, in the direction of travel, in order to achieve a better position of the center of gravity for the following procedure, which is shown in FIG. 5. Fixed bridge 12 is moved entirely to the front, and slide frame 8 is extended to the rear while being guided by sets of rollers 10, 11. The movement of fixed bridge 12 to the front and that of slide frame 8 to the rear can occur simultaneously or in succession; however, it is advantageous if the center of gravity of fixed bridge 12 is always located over motor vehicle 1 and preferably in front of rear axle 7.

Figure 6:
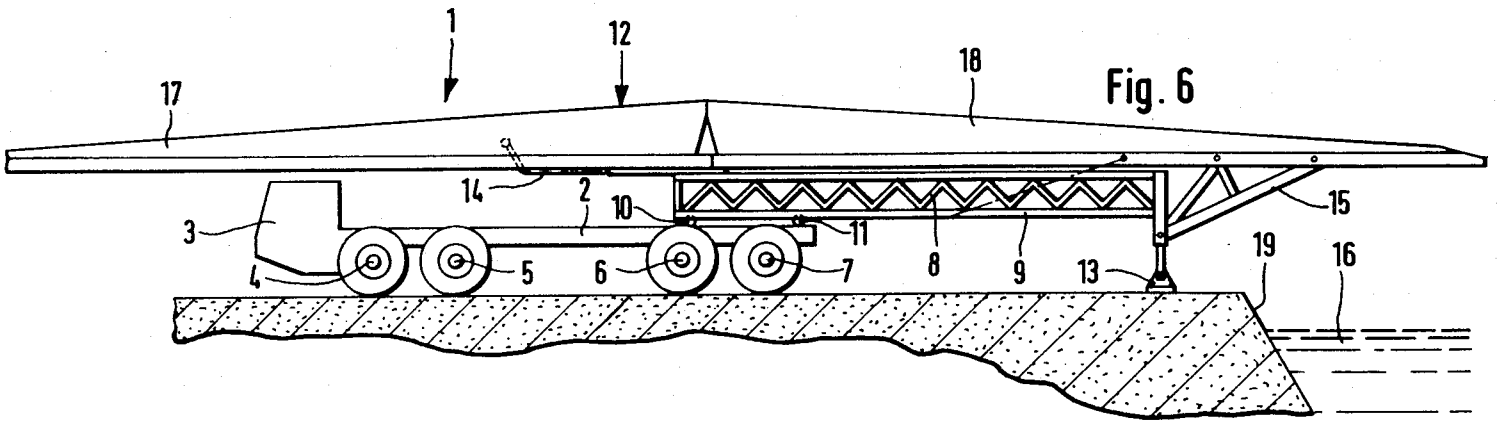

FIG. 6 shows the final position of slide frame 8 with extended support legs 13 resting on the ground, so that slide frame 8 is now supported at both ends like a bridge.

Figure 7:
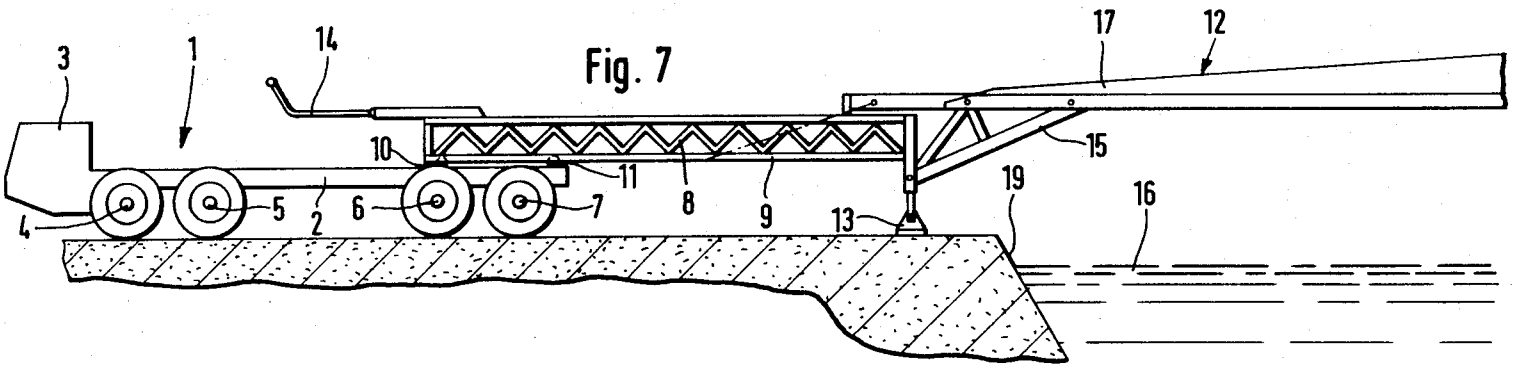

FIG. 7 shows how fixed bridge 12 was moved from its front position shown in FIGS. 5 and 6 entirely to the rear and how it spans body of water 16, which is not shown in its entirety. This is the critical load state, at which the tipping moment caused by fixed bridge 12 is the greatest. However, the weight of fixed bridge 12 is conducted over support legs 13 directly into the ground, whereby slide frame 8 and especially the heavy bridge-laying vehicle 1 act as a counterweight. As a result of the extended slide frame 8, the active lever arm on which bridge-laying vehicle 1 acts with its center of gravity is extremely large, so that very long and therefore heavy fixed bridges 12 can be laid even by rather light bridge-laying vehicles 1.

Figure 8:
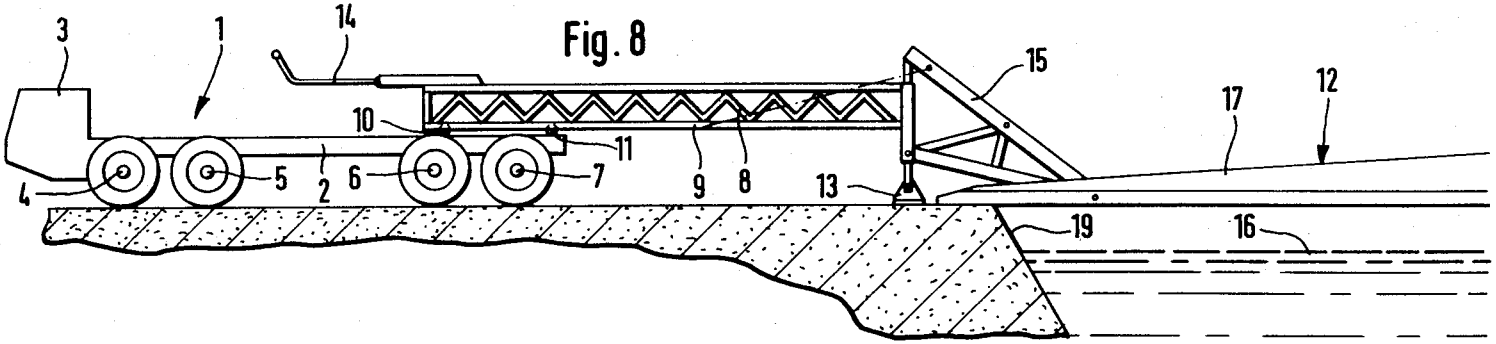

In FIG. 8 laying arm 15 is pivoted entirely downward, so that fixed bridge 12 rests on both banks 19. After laying arm 15 has been uncoupled, fixed bridge 12 can be used. Fixed bridge 12 is taken up in essentially the opposite order.

Figure 9:
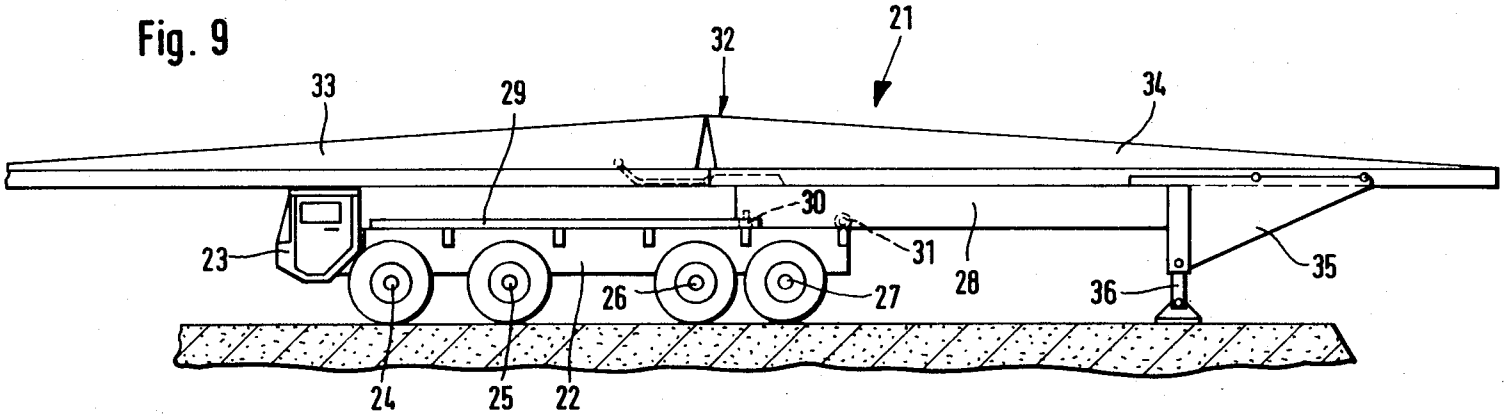
FIG. 9 shows another embodiment of a motor vehicle with a fixed bridge during a laying procedure.

FIG. 9 shows a somewhat different embodiment of a bridge-laying vehicle 21. As in the embodiment of FIGS. 1 to 8, bridge-laying vehicle 21 has a chassis frame 22 with a driver's cab 23 at the front and four wheel axles 24, 25, 26, 27.

A slide frame 28 is likewise set on chassis frame 22; however, it is different from the example shown in FIGS. 1 to 8. In this instance chassis frame 22 has two guide tracks 29 which run longitudinally and are placed at a distance next to one another. Slide frame 28 has only one set of rollers 30 at its front end (seen in the direction of travel), the rollers of which, located on boths sides, fit from the inside into guide tracks 29, so that they are supported vertically. Vertically mounted rollers 31 which limit the lateral movement of slide frame 28 are located at the back of chassis frame 22.

A fixed bridge 32 with bridge segments 33, 34, which are already coupled to one another in this view, is located on slide frame 28. As in the embodiment of FIGS. 1 to 8, a laying arm 35 and support legs 36 are attached to the rear end of slide frame 28.

The laying procedure is performed as follows in this embodiment:

In travel position slide frame 28, support legs 36, laying arm 35 and bridge segments 33, 34 assume the same position as in FIG. 1, only slide frame 28 rests in front on the set of rollers 30 in guide tracks 29, is loose at the rear and is guided laterally by rollers 31. In order to set fixed bridge 32 down, support legs 36 are first lowered far enough that slide frame 28 rises up somewhat from the end of bridge-laying vehicle 21. Then, bridge-laying vehicle 21 drives forward, while support frame 28 remains in place on account of extended support legs 36 and set of rollers 30 rolls to the rear in guide tracks 29. Bridge-laying vehicle 21 drives forward until set of rollers 30 strikes against the rear end of guide tracks 29. Then, support legs 36 are retracted until slide frame 28 just rests on the end of bridge-laying vehicle 21. Then, fixed bridge 32 is pulled apart and coupled in the same manner as is shown in FIGS. 2 and 3. Then, it is pushed out over the particular barrier, e.g. a body of water, until it is hanging only from laying arm 35, as in FIG. 7. Then, fixed bridge 32 is set down as is shown in FIG. 8.

Slide frame 28 is pushed onto bridge-laying vehicle 21 as follows: It is again raised slightly by support legs 36 and bridge-laying vehicle 21 is backed until set of rollers 30 strikes the front end of guide tracks 29. Support legs 36 are hen entirely retracted and slide frame 28 is locked onto bridge-laying vehicle 21.

We claim:

1. A motor vehicle for transporting and laying a fixed bridge, comprising:

(a) a ground supported vehicle including a chassis with a front and a rear;

(b) a slide frame longitudinally displacably mounted to said chassis and having a first travel position and a second extended position wherein a first end of sad slide frame is disposed a substantial distance from said vehicle rear and said slide frame has an upper and a lower surface;

(c) a support leg secured generally to said first end having a ground engaging portion extending beyond said lower surface supporting said slide frame while in said extended position;

(d) a bridge member carried by said slide frame having a first position supported by said upper surface and a second position remote from said slide frame; and, (e) bridge member laying and displacement means connected generally to said first end for displacing said bridge member and said laying means includes a rearwardly extending portion adapted for supporting said bridge member during displacement thereof whereby said laying means is adapted for being moved from a first bridge member supporting position to a second laying position for thereby laying said bridge member over an obstacle.

2. The vehicle as defined in claim 1, wherein:

(a) said slide frame has a length substantially equal to the length of said chassis.

3. The vehicle as defined in claim 1, wherein:

(a) said slide frame has a pair of sides; and, (b) a support leg is secured to each of said sides at generally said first end.

4. The vehicle as defined in claim 1, wherein:

(a) side support leg includes an extensible portion.

5. The vehicle as defined in claim 4, wherein:

(a) said slide frame is pivotally and longitudinally displacably mounted to said chassis; and, (b) said extensible portion is adapted for pivoting said slide frame and thereby raising said first end from said chassis.

6. The vehicle as defined in claim 1, wherein:

(a) a plurality of roller means are secured to said vehicle, and, (b) means are secured to said slide frame and cooperate with said roller means for guiding said slide frame during displacement thereof.

7. The vehicle as defined in claim 6, wherein:

(a) said means includes at least a first guide track.

8. The vehicle as defined in claim 6, wherein:

(a) a first and second set of roller means are mounted to said vehicle in spaced longitudinal relation.

9. The vehicle as defined in claim 8, wherein:

(a) a first one of said sets is secured to said rear and the other of said sets is mounted forwardly thereof.

10. The vehicle as defined in claim 1, wherein:

(a) roller means are secured to said chassis at generally said rear and support said slide frame and limit lateral movement thereof.

11. The vehicle as defined in claim 1, wherein:

(a) roller means are secured to said slide frame; and, (b) means are connected to said vehicle and cooperate with said roller means for guiding said slide frame during displacement thereof.

12. The vehicle as defined in claim 11, wherein:

(a) said means includes at least a first guide track.

13. The vehicle as defined in claim 11, wherein:

(a) said slide frame has a second end spaced from said first end and associated with said front; and, (b) a set of roller means are secured generally to said second end.

14. A motor vehicle for transporting and laying a fixed bridge, comprising:

(a) a ground supported vehicle including a chassis with a front and a rear;

(b) a slide frame longitudinally movably mounted to said chassis and having a first travel position and a second extended position wherein a first end of said slide frame extends beyond said vehicle rear and said slide frame has an upper and a lower surface;

(c) a support leg is secured to said slide frame at generally said first end and has a ground engaging portion extending beyond said lower surface supporting said slide frame while in said extended position and thereby providing with said vehicle a first lever arm extending from said support leg;

(d) a bridge member associated with said slide frame having a first position supported by said upper surface and a second position remote from said slide frame; and, (e) bridge member laying and displacing means connected to generally said first end adapted for displacing and laying said bridge member when said slide frame is in said second position and for supporting said bridge member during movement thereof as said bridge member is layed over an obstacle and displacement of said bridge member provides a second lever arm extending from said support leg in a direction generally opposite to said first lever arm and said first lever arm generates a moment exceeding the moment of said second lever arm during laying of said bridge member.

15. The vehicle as defined in claim 14, wherein:

(a) said slide frame has a length substantially equal to the chassis length.

16. The vehicle as defined in claim 14, wherein:

(a) said slide frame has a pair of sides; and, (b) a support leg is secured to each of said sides.

17. The vehicle as defined in claim 16, wherein:

(a) each of said support legs has an extensible portion.

18. The vehicle as defined in claim 17, wherein:

(a) said slide frame is pivotally and longitudinally displacably mounted to said chassis; and, (b) each of said extensible portions is adapted for pivoting said slide frame and thereby raising said first end from said chassis.

19. The vehicle as defined in claim 14, wherein:

(a) a plurality of roller means are secured to said vehicle; and, (b) means are connected to said slide frame and cooperate with said roller means for guiding said slide frame during displacement thereof.

20. The vehicle as defined in claim 19, wherein:

(a) said means includes at least a first guide track.

21. The vehicle as defined in claim 19, wherein:

(a) a first and second set of roller means are mounted to said vehicle in spaced longitudinal relation.

22. The vehicle as defined in claim 21, wherein:

(a) a first one of said sets is secured to said rear and the other of said sets is mounted forwardly thereof.

23. The vehicle as defined in claim 14, wherein:

(a) roller means are connected to said chassis at generally said rear and support said slide frame and limit lateral movement thereof.

24. The vehicle as defined in claim 14, wherein:

(a) roller means are secured to said slide frame; and, (b) means are connected to said vehicle and cooperate with said roller means for guiding said slide frame during displacement thereof.

25. The vehicle as defined in claim 24, wherein:

(a) said means includes at least a first guide track.

26. The vehicle as defined in claim 24, wherein:

(a) said slide frame has a second end spaced from said first end and associated with said front; and, (b) a roller means set is secured generally to said second end.

* * * * *